US008015905B2

(12) United States Patent
Park

(10) Patent No.: US 8,015,905 B2
(45) Date of Patent: Sep. 13, 2011

(54) NON-LETHAL ELECTRICAL DISCHARGE WEAPON HAVING A BOTTOM LOADED CARTRIDGE

(76) Inventor: Samuel Sung Wan Park, La Canada, CA (US)

( * ) Notice: Subject to any disclaimer, the term of this patent is extended or adjusted under 35 U.S.C. 154(b) by 0 days.

(21) Appl. No.: 11/085,366

(22) Filed: Mar. 21, 2005

(65) Prior Publication Data

US 2006/0225333 A1 Oct. 12, 2006

(51) Int. Cl.
*F41F 5/00* (2006.01)
*B64D 1/04* (2006.01)

(52) U.S. Cl. ..... 89/1.11; 361/232; 102/502

(58) Field of Classification Search ..... 361/232; 89/1.11; 42/1.08, 50, 84; 102/502, 512
See application file for complete search history.

(56) References Cited

U.S. PATENT DOCUMENTS

| | | | | |
|---|---|---|---|---|
| 3,523,538 | A * | 8/1970 | Shimizu Kunio | 607/58 |
| 5,654,867 | A * | 8/1997 | Murray | 361/232 |
| 5,698,815 | A * | 12/1997 | Ragner | 102/502 |
| 6,360,645 | B1 * | 3/2002 | McNulty et al. | 89/1.11 |
| 6,575,073 | B2 * | 6/2003 | McNulty et al. | 89/1.11 |
| 6,862,994 | B2 * | 3/2005 | Chang | 102/502 |
| 7,075,770 | B1 * | 7/2006 | Smith | 361/232 |
| 2005/0109200 | A1 * | 5/2005 | McNulty, Jr. | 89/1.11 |
| 2006/0120009 | A1 * | 6/2006 | Chudy | 361/232 |

* cited by examiner

*Primary Examiner* — Troy Chambers
(74) *Attorney, Agent, or Firm* — Leonard Tachner

(57) ABSTRACT

The present invention comprises a pistol-shaped Taser™-type weapon wherein the cartridge containing a pair of the wire-tethered darts is loaded into the cartridge receiving chamber from beneath the weapon, that is, in an upward movement of the cartridge with the weapon pointed toward the target. This type of loading is referred to herein as a "bottom loading" mechanism or system. The bottom loading mechanism of the present invention has significant advantages over conventional cartridge loading designs. One advantage is reduced reload time.

10 Claims, 4 Drawing Sheets

NON-LETHAL ELECTRICAL DISCHARGE WEAPON HAVING A BOTTOM LOADED CARTRIDGE

BACKGROUND OF THE INVENTION

1. Field of the Invention

The present invention relates generally to an electrical discharge weapon having replaceable cartridges, each carrying a pair of wire-tethered darts that are propelled toward a remote target for imparting a temporarily disabling electrical shock. The invention relates more specifically to such a weapon and cartridges wherein the cartridges may be bottom loaded into the weapon's firing chamber to significantly reduce reloading time after a cartridge has been spent.

2. Background Art

Electrical discharge weapons capable of firing wire tethered darts at remote targets have become useful non-lethal alternatives for police officers to subdue uncooperative and potentially dangerous subjects. Typically, such wire-tethered darts and a suitable propulsion mechanism are contained in replaceable cartridges which are loaded into the weapon for firing. Once the cartridges are spent, they may be removed and replaced by a new cartridge ready for subsequent firing. In typical electrical discharge weapons, the cartridges are received in a front-facing chamber with dart exit apertures directed toward the target. Usually, the cartridges are front-loaded into the weapon, that is, the loading direction is parallel to the line of sight between the weapon and the remote target as the weapon is pointed toward the target in a position that is ready to fire. In weapons that are shaped like pistols, the cartridge is loaded into what would be comparable to the front of the barrel of the pistol with the pistol aimed at the target. The cartridge is typically either received in a hollow congruent chamber into which the cartridge is inserted or is clipped on to the weapon's barrel end in an axially-directed motion. Usually, a spent cartridge is removed by an opposite motion wherein the used cartridge is translated parallel to the barrel in a direction toward the target. Such translation of the spent cartridge is usually accompanied or preceded by activation of a latch mechanism to release the cartridge from the weapon.

There can be occasions when the number of steps or distinct body motions and resulting reload time can become critical to the safety of a police officer and even to an assailant who may be threatening an officer. When an officer has to reload his non-lethal electrical discharge weapon, it usually means that for one reason or another his or her first "shot" has been ineffective. Perhaps one of the two wire-tethered darts missed hitting the target thereby precluding a completed electrical circuit through the target. Perhaps the darts impacted the target either too close together or too far apart to provide an effective and disabling electrical current. In any case, a subsequent attempt becomes necessary and the assailant does not often stand idly while the officer reloads his weapon. Often, the assailant becomes more agitated and more likely to attack the officer after a failed attempt to subdue him or her has occurred. For this reason, it is clearly important that the officer have the ability to reload as quickly as possible and not have to resort to use of his lethal weapon to protect himself which would, of course, endanger the life of the assailant.

It would therefore be highly advantageous if a Taser™-type weapon were configured for faster reloading as compared to currently available Taser™-type weapons.

SUMMARY OF THE INVENTION

The present invention comprises a pistol-shaped Taser™-type weapon wherein the cartridge containing a pair of the wire-tethered darts is loaded into the cartridge receiving chamber from beneath the weapon, that is, in an upward movement of the cartridge with the weapon pointed toward the target. This type of loading is referred to herein as a "bottom loading" mechanism or system.

The bottom loading mechanism of the present invention has significant advantages over conventional cartridge loading designs. One advantage is reduced reload time. This advantage may be best understood by comparing the biomechanics required to reload a current market product, the Taser™ X26 from Taser International™, to the biomechanics needed to reload a product using the bottom loading system.

In brief, once the Taser™ X26 (or any other product requiring a "clip-on" Taser™ cartridge) weapon is discharged, the contralateral hand must reach forward to the end of the weapon, grasp and remove the expended cartridge to unload the weapon. To complete the reload cycle, the contralateral hand must drop the expended cartridge, grasp the next cartridge and reach forward to the front of the Taser™ to reload the weapon.

With a bottom loading system, once the weapon is discharged, one finger of the weapon holding hand can disengage the latch holding the cartridge. This allows the cartridge to fall to the ground by gravity. Only one hand is required to unload the weapon. This significantly reduces the time required for a reload cycle and allows the free contralateral hand to have the next cartridge in waiting, further decreasing the load time.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
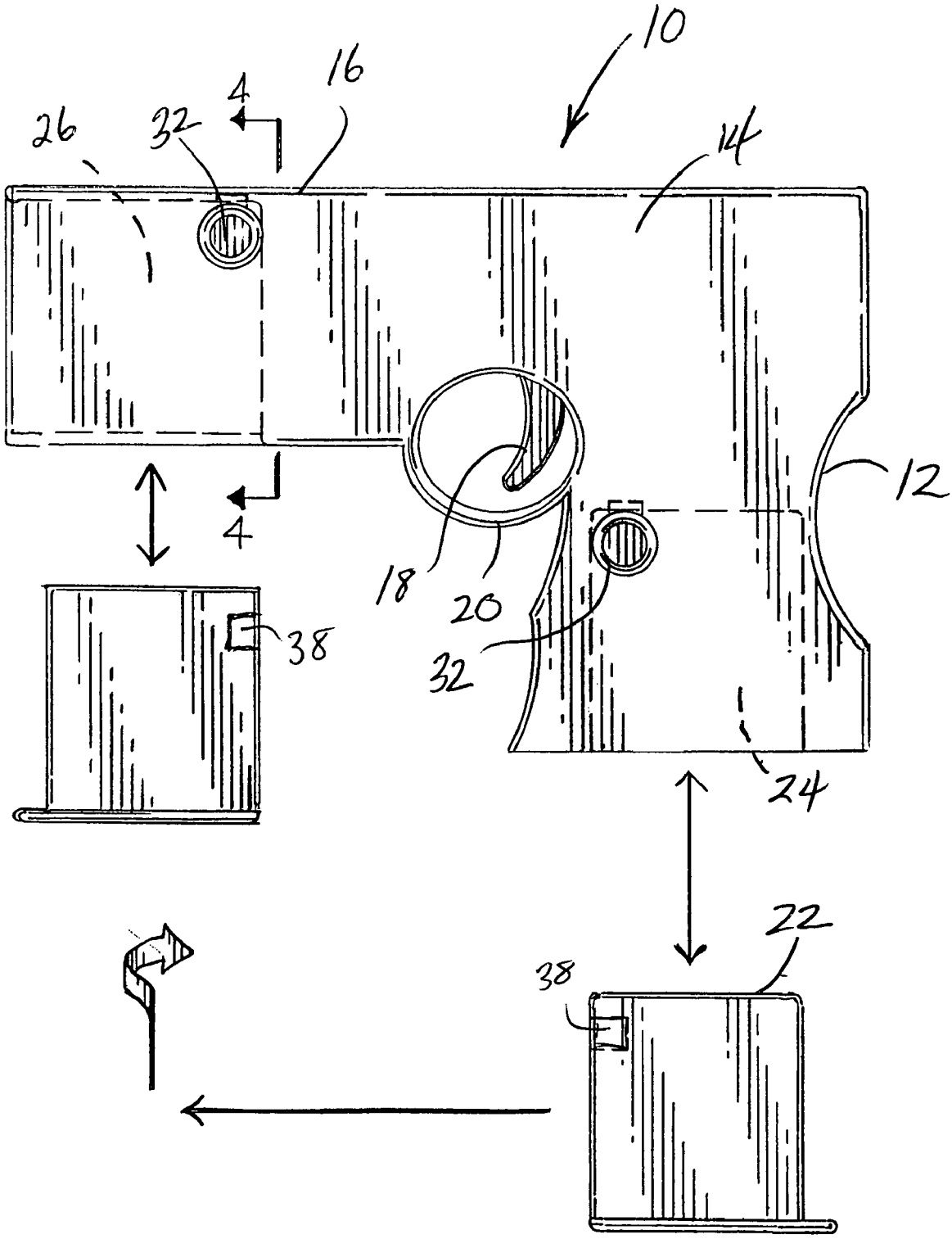
FIG. 1 is an exploded sequential side view of a preferred embodiment of the invention.
Figure 2:
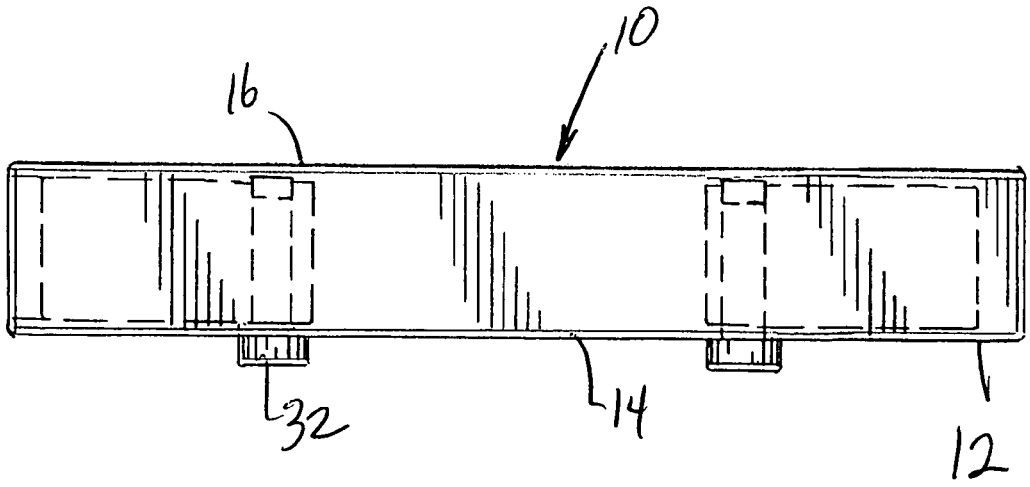
FIG. 2 is a top view of the preferred embodiment.
Figure 3:
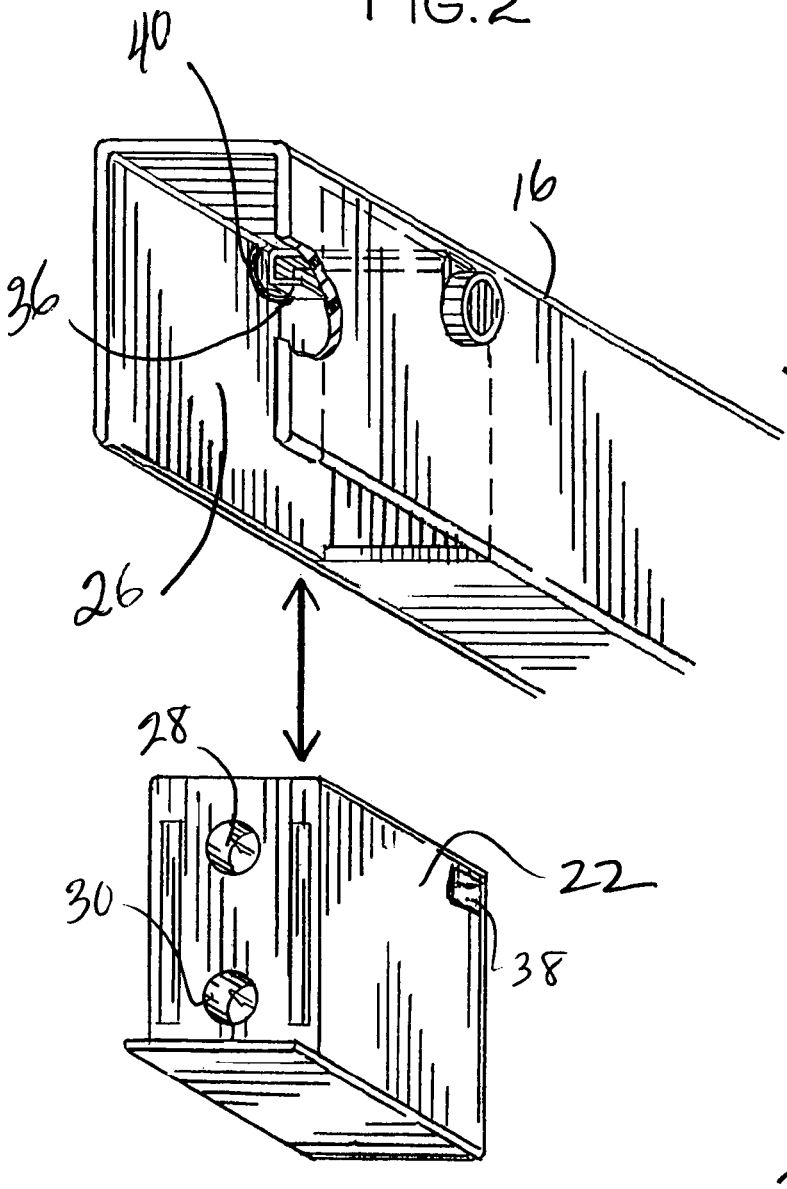
FIG. 3 is a three-dimensional view of the cartridge and cartridge chamber of the preferred embodiment.
Figure 4:
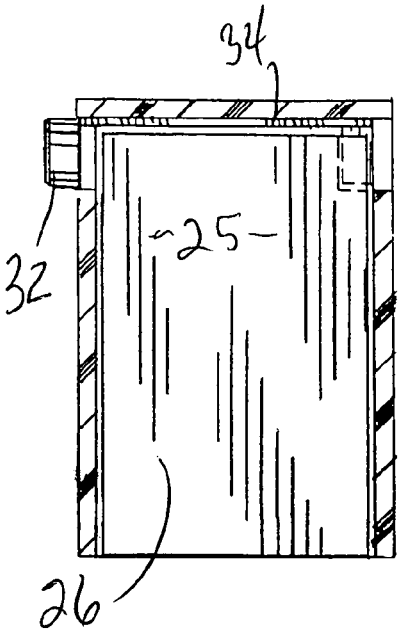
FIG. 4 is a cross-sectional view taken along lines 4-4 of FIG. 1.
Figure 5:
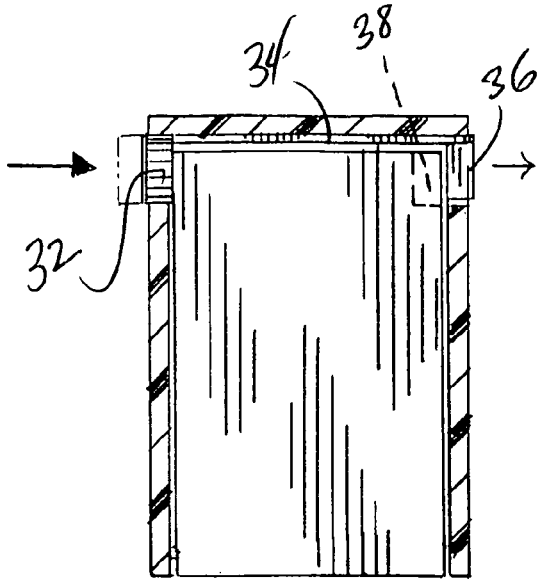
FIG. 5 is a view similar to FIG. 4 at initial activation of the cartridge release mechanism.
Figure 6:
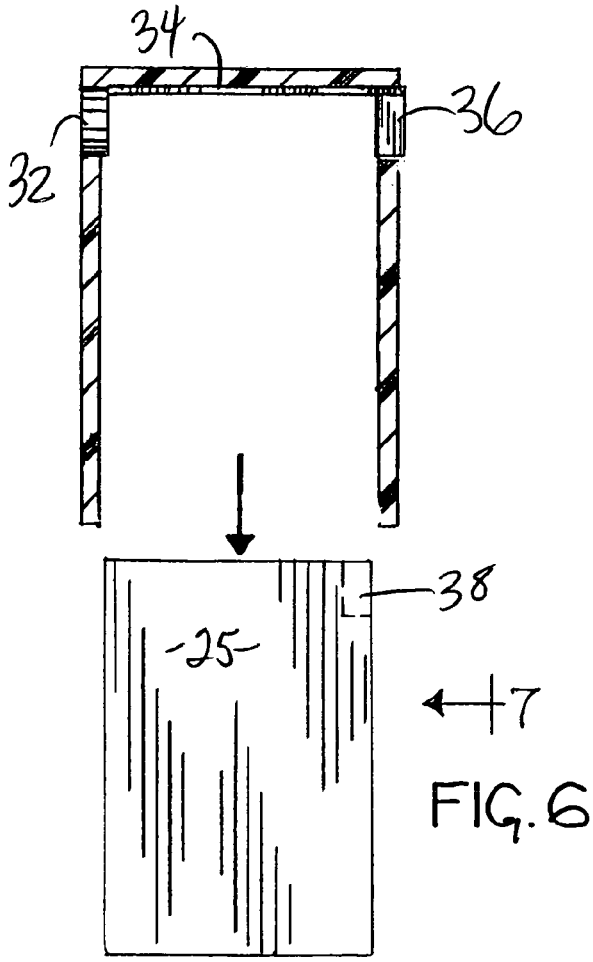
FIG. 6 is a view similar to FIG. 4 at a later instant after release activation.
Figure 7:
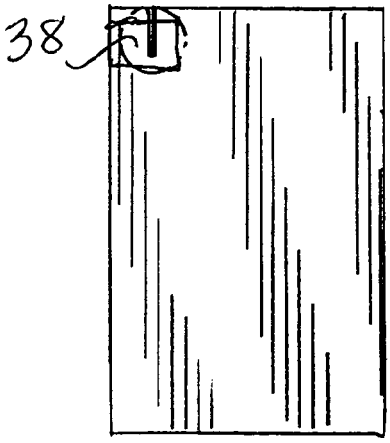
FIG. 7 is a side view of a released cartridge as seen along line 7 of FIG. 6.

Referring to the accompanying drawings and to FIGS. 1-3 in particular, it will be seen that a Taser™-type weapon 10 comprises a handle portion 12, a body portion 14 and a barrel portion 16. Also provided are an actuating trigger switch 18 within a trigger guard 20. Handle portion 12 provides a spare cartridge bay 24 to receive a spare cartridge 22. Barrel portion 16 terminates in a cartridge chamber 26 designed to receive a cartridge 22 for activation of the weapon 10. Cartridge 22 has a pair of apertures 28 and 30 through which wire-tethered darts (not shown) may be propelled toward a remote target upon activation of the weapon.

As seen best in FIG. 3, chamber 26 has two contiguous openings, one in front of the weapon and one below the weapon. In this manner, cartridge 22 is readily inserted into chamber 26 from below barrel portion 16 in an upward motion as depicted in FIG. 3. The cartridge 22 will, of course, have appropriately positioned electrical contacts (not shown) to mate with contacts (not shown) within chamber 26 to activate dart propulsion and apply an electrical current through the wire-tethered darts (not shown) in a well-known manner in the Taser™ weapon art. Body portion 14 houses the batteries, circuits and high voltage transformer typically used in such weapons to effect operation as in typical conventional Taser™-type weapons and such known components and operation need not be disclosed herein.

Because cartridge 22 is released from bay 24 and from chamber 26 by simple effects of gravity, the latch and release mechanism is also simple. As shown in FIGS. 3-7, a release button 32 is connected to an arm 34 to a latch 36. Arm 34 is preferably spring loaded to remain in the latched position shown in FIGS. 3 and 4 where it will nominally secure the cartridge by positioning latch 36 in a recess 38 in the cartridge case 25. The spring force of arm 34 should be sufficient to preclude inadvertent release of the cartridge and to prevent undesirable cartridge motion which would otherwise interrupt electrical contact during activation. When release button 32 is forcefully depressed, arm 34 transits across the inner top surface of chamber 26 (as well as bay 24) to move latch 36 out of recess 38 thereby allowing cartridge 22 to free fall out of chamber 26 (or out of bay 24). The release mechanism for storing a cartridge in bay 24 is preferably identical, but the cartridge is reversed to place the release latch closer to the officer's thumb. A recess 38 is provided on both sides of the cartridge for this purpose.

Figure 8:
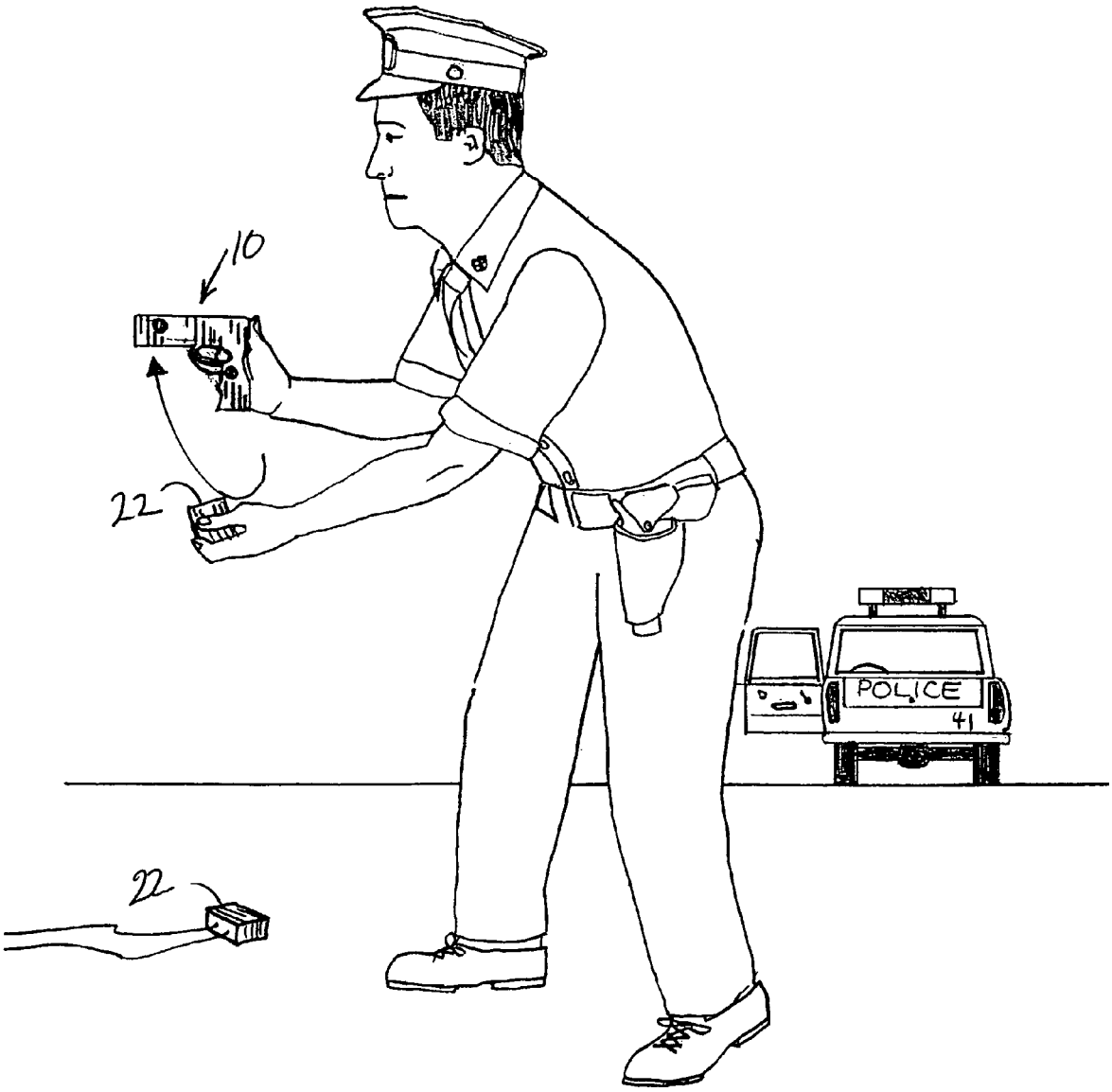
FIG. 8 is a depiction of the invention in use by an officer.

As shown in FIG. 8, with a released spent cartridge 22 on the ground, the officer releases the stored fresh cartridge and thrusts it into the chamber, all while containing to aim the weapon 10 at the target.

In order to compare the biomechanics for reloading of Taser™ X26 to a bottom loading system, it will be assumed that both weapons are discharged under similar conditions. We will assume that a right-handed officer is standing fully upright holding the Taser™ X26 in his dominate hand. The person is holding X26 in a classical pistol firearm position: Bilateral shoulders are forward flexion 90 degrees. Right shoulder with neutral in abduction/adduction, left shoulder abducted 45 degrees, right elbow fully extended, left flexed 45 degrees, right forearm neutral to supination/pronation, right hand/fingers flexed to hold the handle of the weapon except for the right ring finger that is flexed over the trigger, left forearm supinated to 80 degrees, left wrist extended 20 degrees with 10 degrees of radial flexion and left hand/fingers flexed to support the right hand.

Once the weapon is discharged by flexion of the right index finger, the left hand now must engage in a series of movements to unload the weapon. In the first set of movements to grasp the discharged cartridge, the left shoulder must be abducted to 60 degrees, left elbow must be extended to 30 degrees of flexion, left forearm supinated to 70 degrees, left wrist to 30 degrees of flexion with 15 degrees of ulnar flexion, left fingers and thumb extended to release the support of the contralateral hand/weapon and finally fingers and thumb flexed to grip the discharged cartridge. The right shoulder will be in the same position, right elbow flexed to 45 degrees, right wrist extended to 50 degrees with 5 degrees of radial flexion. Twelve movements are required to remove the cartridge from the weapon. The following movements are required to remove the expended cartridge. The left shoulder will remain in the same position, left elbow fully extended, wrist extended to 20 degrees with 20 degrees of radial flexion. Removing the cartridge will take three movements. Finally to free the left hand of the used cartridge and prepare for grasping of the next cartridge, the forearm must be pronated past neutral and the fingers and then thumb extended, for additional three movements. Hence a total of 18 gross movements are required for unloading of the expended cartridge in a Taser™ X26 front loading cartridge device.

We will again assume that a right-handed officer is standing fully upright holding the weapon equipped with a bottom loading system of the invention in his dominant hand. The person is holding a classical pistol firearm position: Bilateral shoulders are forward flexion 90 degrees, right shoulder with neutral in abduction/adduction, left shoulder abducted 45 degrees, right elbow fully extended, left flexed 45 degrees, right forearm neutral to supination/pronation, right hand/fingers flexed to hold the handle of the weapon, except for the ring finger, which is extended to the latch that releases the cartridge and the middle finger, which is flexed over the trigger. The left forearm supinated to 80 degrees, wrist extended 20 degrees with 10 degrees of radial flexion and left hand/fingers flexed to support the right hand.

Once the weapon is fired by flexion of the right middle finger, the right index finger's proximal phalangeal must be flexed to 45 degrees. This will pull the latch proximal and disengage the cartridge, allowing the expended cartridge to fall by gravity. Hence a total of one gross body movement is required for unloading an expended cartridge in a Taser™ with a bottom loading system.

Loading the weapon is also more efficient with the bottom loading system. First for both the front loading and the bottom loading system, the right hand dominant male must grasp the replacement cartridge with the left from a level below the right hand that is grasping the weapon. With the Taser™ X26 equipped with the front loading clip system, the left shoulder will be 90 degrees of forward flexion, left elbow fully extended, left forearm supinated to 80 degrees with 20 degrees of ulnar flexion in order to position the new cartridge for loading. Then the left elbow is flexed to 30 degrees with the wrist moved to 10 degrees of ulnar flexion to clip-on the new cartridge. These six movements will complete the attachment of the new cartridge. The right elbow will be fully extended to return to the classical firing position, thus requiring additional gross movement. Hence 25 total movements will be required before the weapon can be fired.

With a weapon equipped with a bottom loading system, the left shoulder will be in forward flexion of 90 degrees, elbow fully extended and forearm in neutral position of supination/pronation with no ulnar or radial flexion. Thus a total of four movements are required for a bottom loading system and the right elbow does not have to be repositioned, as the right upper extremity is in the correct firing position throughout the cycle. A total of 25 gross movements are required to replace an old with a new cartridge in a front-loading weapon as compared to seven movements using a bottom loading system. This equates to a considerable reduction in time to reload and hence a significant time savings to re-fire the weapon. Furthermore, the hand contralateral to the weapon is not used during the unload cycle and thus can prepare for the loading, further optimizing the time required to change cartridges. Last, the bottom loading system allows for the weapon to be continuously aimed at the target throughout the unloading and loading cycle, again increasing the chance for a successful re-fire. Hence, a bottom loading system offers significant advantages compared to a clip-on front-loading cartridge.

Having thus disclosed a preferred embodiment of a bottom loading system in a Taser™-type pistol shaped weapon, it will now be apparent that numerous variations are contemplated.

By way of example, the shape of the cartridge, cartridge chamber and release mechanism therefore, may be readily modified while retaining the inventive features of the invention. Therefore, the scope hereof is to be limited only by the appended claims and their equivalents.

I claim:

1. In an electrical discharge weapon having a hand gun shape with a barrel having an open end forming a chamber at said open end and receiving a cartridge with a pair of wire-tethered darts for propulsion toward a remote target along a line of sight from the weapon to the target, the chamber comprising an opening for receiving a cartridge by motion in a direction that is substantially perpendicular to said line of sight.

2. The electrical discharge weapon recited in claim 1 wherein said chamber opening is oriented toward the bottom of said weapon for receiving said cartridge from below said weapon.

3. The electrical discharge weapon recited in claim 1 wherein said chamber further comprises a release mechanism for selectively releasing a cartridge from said weapon.

4. The electrical discharge weapon recited in claim 2 wherein said chamber further comprises a release mechanism to selectively permit said cartridge to fall out from said chamber while said weapon is being aimed at said target.

5. The electrical discharge weapon recited in claim 1 wherein said cartridge is stored in an alternate location on said weapon for removal from said alternate location before being received through said chamber opening.

6. The electrical discharge weapon recited in claim 5, said weapon having a handle portion and wherein said handle portion comprises said alternate location.

7. The electrical discharge weapon recited in claim 6 wherein said handle portion comprises a release mechanism for selectively releasing a stored cartridge from said alternate location.

8. An electrical discharge weapon having a hand gun shape with a barrel having an open end forming a chamber at said open end and receiving a cartridge for firing wire-tethered darts toward a remote target, the chamber comprising a first opening for passing said cartridge into the chamber and into a firing position and a second opening directed toward said target to allow exiting of said wire-tethered darts from said weapon toward said target.

9. The electrical discharge weapon recited in claim 8 wherein said first and second openings have directions which are substantially perpendicular to one another.

10. The electrical discharge weapon recited in claim 9 wherein the direction of said first opening is oriented for bottom loading of said cartridge into said chamber while said weapon is aimed at a target.

* * * * *